US009576470B2

(12) United States Patent
Jensen

(10) Patent No.: US 9,576,470 B2
(45) Date of Patent: Feb. 21, 2017

(54) APPLICATION SUCH AS AN ELECTRICALLY ADJUSTABLE BED OR ELECTRICALLY DRIVEN PATIENT LIFT

(75) Inventor: Svend Erik Knudsen Jensen, Sønderborg (DK)

(73) Assignee: Linak A/S, Nordborg (DK)

( * ) Notice: Subject to any disclaimer, the term of this patent is extended or adjusted under 35 U.S.C. 154(b) by 458 days.

(21) Appl. No.: 12/448,639

(22) PCT Filed: Jan. 2, 2008

(86) PCT No.: PCT/DK2008/000001

§ 371 (c)(1),
(2), (4) Date: Jun. 29, 2009

(87) PCT Pub. No.: WO2008/080404

PCT Pub. Date: Jul. 10, 2008

(65) Prior Publication Data

US 2009/0299528 A1 Dec. 3, 2009

(30) Foreign Application Priority Data

Dec. 31, 2006 (DK) ..... 2006 01720

(51) Int. Cl.

| | |
|---|---|
| ***A47B 7/02*** | (2006.01) |
| ***G05B 1/01*** | (2006.01) |
| ***G05B 19/18*** | (2006.01) |
| ***G05B 15/00*** | (2006.01) |
| ***G08C 17/02*** | (2006.01) |
| ***G08C 23/04*** | (2006.01) |

(52) U.S. Cl.

CPC ..... *G08C 17/02* (2013.01); *G08C 23/04* (2013.01); *G08C 2201/20* (2013.01)

(58) Field of Classification Search

CPC ..... G08C 17/02; G08C 23/04; G08C 2201/20; C23C 14/35; C23C 16/26; C23C 16/50; H01J 37/32669; H01J 37/32422; H01J 37/32568

USPC ..... 5/616–624; 700/11, 65, 83; 455/352, 455/556.2, 362; 45/362, 556.2

See application file for complete search history.

(56) References Cited

U.S. PATENT DOCUMENTS

| | | | | | |
|---|---|---|---|---|---|
| 3,821,821 | A | * | 7/1974 | Burst et al. | 5/616 |
| 3,845,472 | A | * | 10/1974 | Buchanan et al. | 370/222 |
| 4,430,828 | A | * | 2/1984 | Oglevee et al. | 47/17 |
| 4,703,306 | A | * | 10/1987 | Barritt | 340/4.35 |
| 4,992,784 | A | * | 2/1991 | Ruttiger | 340/12.52 |
| 5,392,025 | A | * | 2/1995 | Figh et al. | 340/547 |

(Continued)

FOREIGN PATENT DOCUMENTS

WO 2005031675 4/2005

OTHER PUBLICATIONS

Microproessor, Text book, 1978, 3 pages.*
Linak Brochure, 2005, 12 pages.*

*Primary Examiner* — Robert Fennema
*Assistant Examiner* — Thomas Stevens
(74) *Attorney, Agent, or Firm* — Dykema Gossett PLLC

(57) ABSTRACT

A combination of an articulated apparatus having an electromechanical actuator, a power supply and a control unit with a unique electronic address, and a cordless controller, the cordless controller becoming exclusively electrically paired to the articulated apparatus when common signals therefrom to the control box include the unique electronic address, thus enabling control of the articulated apparatus when located near the other apparatus having other electronic addresses.

9 Claims, 3 Drawing Sheets

(56) References Cited

U.S. PATENT DOCUMENTS

| | | | | |
|---|---|---|---|---|
| 5,412,377 | A * | 5/1995 | Evans et al. | 340/4.35 |
| 5,511,256 | A * | 4/1996 | Capaldi | 5/83.1 |
| 5,544,376 | A * | 8/1996 | Fromson | 5/618 |
| 5,781,143 | A * | 7/1998 | Rossin | 341/173 |
| 5,787,528 | A * | 8/1998 | Antinori | 5/616 |
| 5,949,351 | A | 9/1999 | Hahm | |
| 6,094,239 | A * | 7/2000 | Weber | 348/734 |
| 6,106,576 | A * | 8/2000 | Fromson | 318/16 |
| 6,305,602 | B1 * | 10/2001 | Grabowski et al. | 235/379 |
| 6,387,065 | B1 * | 5/2002 | Tumey | 601/152 |
| 6,516,202 | B1 * | 2/2003 | Hawkins et al. | 455/556.2 |
| 6,522,937 | B2 * | 2/2003 | Ette et al. | 700/87 |
| 6,570,491 | B1 * | 5/2003 | Bastholm | 340/10.3 |
| 7,082,339 | B2 * | 7/2006 | Murray et al. | 700/83 |
| 7,237,287 | B2 * | 7/2007 | Weismiller et al. | 5/616 |
| 7,346,944 | B2 * | 3/2008 | Shaw | 5/616 |
| 7,679,520 | B2 * | 3/2010 | Zerhusen et al. | 340/573.1 |
| 7,690,059 | B2 * | 4/2010 | Lemire et al. | 5/600 |
| 7,933,669 | B2 * | 4/2011 | Rawls-Meehan | 700/83 |
| 2001/0002365 | A1 * | 5/2001 | Minakuchi et al. | 455/556 |
| 2002/0014951 | A1 * | 2/2002 | Kramer et al. | 340/5.8 |
| 2004/0149891 | A1 * | 8/2004 | Cho et al. | 250/214 R |
| 2004/0215815 | A1 * | 10/2004 | Rekimoto | 709/236 |
| 2004/0235446 | A1 * | 11/2004 | Flaherty et al. | 455/352 |
| 2005/0172405 | A1 * | 8/2005 | Menkedick et al. | 5/618 |
| 2005/0200499 | A1 | 9/2005 | DiPeppe | |
| 2005/0251915 | A1 * | 11/2005 | Elizondo | 5/611 |
| 2006/0149338 | A1 * | 7/2006 | Flaherty et al. | 607/49 |
| 2007/0000055 | A1 * | 1/2007 | Donaldson | 5/607 |
| 2007/0157385 | A1 * | 7/2007 | Lemire et al. | 5/600 |
| 2011/0291795 | A1 * | 12/2011 | Rawls-Meehan | 340/3.7 |

* cited by examiner

APPLICATION SUCH AS AN ELECTRICALLY ADJUSTABLE BED OR ELECTRICALLY DRIVEN PATIENT LIFT

AREA OF THE INVENTION

The present invention relates to an application (apparatus) such as electrically adjustable beds, electrically driven patient lifters with an actuator system comprising at least one electromechanical actuator, a power supply and a control unit and a cordless control.

BACKGROUND

It is often desirable to be able to use a cordless control, for instance of the type used for remote control of televisions, for controlling electrically adjustable beds, electrically driven patient lifters, etc.

The controls are typically IR-based. There are many ways of encoding these IR-signals, which is why problems with confusion between functions hardly ever occur, even though there are many different types of products such as televisions and radios in private homes, which may also be controlled by IR.

If these controls are applied to beds, patient lifters, etc., in nursing homes, hospitals and the like, they would, unlike in private homes, often be used in surroundings with many similar units based on the same signal. This could result in the unfortunate consequence that for instance multiple beds are adjusted when a button on a random control is activated.

OBJECT AND BRIEF DESCRIPTION OF THE INVENTION

The invention solves this problem in that all applications, for instance beds, each have their own unique address. When a command is sent from a hand control, this command contains a specific address for exactly that application.

When the hand control has to send the address of a specific application, it implies that it must to know the address. This can for instance be solved in that the hand controls are paired with respective applications at the time of manufacturing. This would, however, be rather inappropriate both logistically and in terms of use. On the contrary, the purpose of the invention is to be able to continuously pair an application and a hand control. In that way all the hand controls can be identical.

In accordance with the invention the hand controls as well as the applications are equipped with both a transmitter and a receiver.

When an application which is to be desirably controlled by the hand control is selected (wished pairing or wished pair) with an application, the hand control transmits a special command otherwise known as a frame, which contains a request for an initialization response and an address.

The application always responds to such a frame with an initialization response containing its own address. This enables the hand control to receive information about the address of the application, which is wished (desired) to be controlled.

If an application receives a request for an initialization response, which as mentioned contains its own address, it responds with the initialization response, but in addition it signals directly to the user that it has received the initialization request with the address. The signaling can for instance be an acoustic response in the form of a buzzer, which gives out a sound, but can also be a visual response like for instance a light indicator.

It is then up to the users to determine from the signaling if they have contact with the intended unit.

If this system is used in a hospital where there for instance are six beds in a ward, the nurse can have her own personal hand control. When she enters a ward and for instance wishes to adjust bed number four, she can walk up to the bed (wished pairing) and activate the initialization function on the hand control, and when she for instance hears the bed respond with a buzzing sound, she will know that her control unit now controls bed number four.

If, on the other hand, she hears bed number three respond instead, she can try moving a little and then resending a request for an initialization response to get bed number four to respond. In order to make the initialization easier, it can for instance be chosen to have the beds transmit with a fairly low IR-power, i.e. a short range. This considerably reduces the likelihood that a wrong bed is activated. Reversed, the control could send its request for an initialization response with a low IR-power, for instance to avoid a situation where a "wrong" bed, ultimately all the beds in a ward, responds.

The invention is here described with IR transmitters/receivers, but is not limited to this. The transmitters/receivers can for instance be radio waves, ultra sound or other possibilities, and can also be a combination of these. Thus, the line of communication from the hand control to the application can be radio waves, while the return communication can be IR.

The invention will be described further with reference to the accompanying drawing.

DESCRIPTION OF PREFERRED EMBODIMENTS

Figure 1:
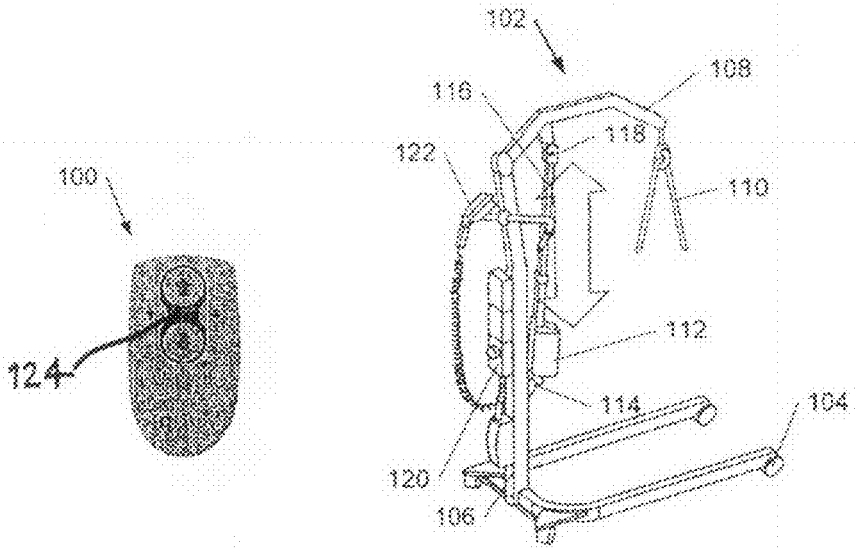
FIG. 1 shows an electrically driven patient lift and a control with cordless communication abilities.

FIG. 1 shows an electrically driven patient lift 102 and a remote control 100 with the ability to communicate cordlessly. The patient lift 102 comprises a chassis 106 equipped with drive wheels 104. An arm 108, pivotal around a horizontal shaft, is with one end attached to the chassis 106. To the other end of the arm 108 a carrying strap 110 for a patient is attached. The arm can be raised and lowered by means of a linear actuator 112, for instance of the type dealt with in EP 531 247 B1 or EP 647 799 B1 for raising or lowering the patient. The actuator 112 is with a rear mounting 114 secured to the chassis 106, and the actuating rod 116 of the actuator is with a front mounting 118 secured to the arm 108. On the chassis is mounted a control box 120 comprising a control unit (not shown) and rechargeable batteries (not shown) for operation of the actuator 112. To the control unit is connected a hand control 122 for maneuvering the arm 108. To the control unit is likewise connected a transmitter/receiver unit, which can communicate cordlessly with external units such as the remote control 100. The remote control 100 can thus also be used for activating the actuator 112 for maneuvering the arm 108. The remote control unit 100 comprises, besides a transmitter/receiver unit (not shown), also a control part with a number of keys 124. By pairing the remote control unit 100 with the control box 120 of the patient lifter 102 at the respective transmitter/receiver units of the two units, the remote control 100 can be used to maneuver the actuator and thereby the arm 108. This pairing is carried out in that the remote control 100 is operated to transmit a special command, a so-called frame, which contains a request for an initialization response and an address. The control box 120 of the patient lift 102 always responds to such a frame with an initialization response containing its own address. This enables the hand control to receive information about the address of the patient lift which the user wishes to control. If a control box 120 on the patient lift 102 receives a request for an initialization response (which contains its own address), it responds with the initialization response, but in addition it signals directly to the user that it has received the initialization request. The signaling can for instance be an acoustic response in the form of a buzzer, which emits a sound, but can also be a visual response like for instance an indicator. As the same remote control can be used for many electrically adjustable patient lifts, beds, etc., it is thus up to the user to determine from the signaling if contact has been established with the desired unit. After having established the pairing, only a one-way communication takes place between these two units, namely from the remote control 100 to the control box 120 on the patient lift 102.

Figure 2:
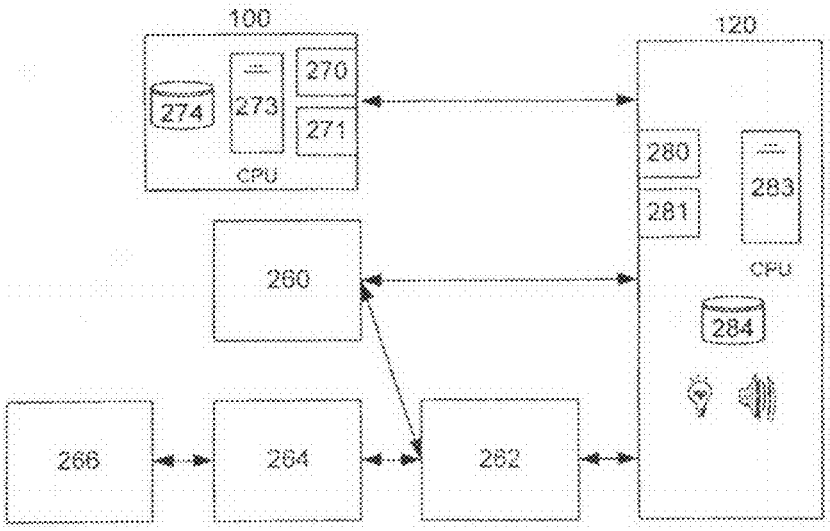
FIG. 2 shows a schematic view of the elements in a system for controlling or servicing a control box of for instance an electrically adjustable bed or an electrically driven patient lift.

FIG. 2 shows a schematic view of a system comprising a control box 120 on for instance an electrically adjustable bed or an electrically driven patient lift, which can communicate and be controlled by a remote control 100 and a service remote control unit 260. The remote control 100 can be used in everyday life and is carried by for instance a nurse. The service remote control 260 can be used for instance for trimming the unit, which is controlled in the same way as the above-mentioned -bed or patient lift. Further, the system also comprises a module for extended service 262, which can communicate via service remote control unit 260 or a computer 266 via an IR/USB module 264. An extended service could for instance comprise reprogramming of the control box 120 or upgrading of its functionality. The remote control 100 comprises receiver 270, transmitter 271, a CPU 273 and a memory 274. The control box 120 likewise comprises a receiver 280, transmitter 281, a CPU 283 and a memory 284.

Figure 3:
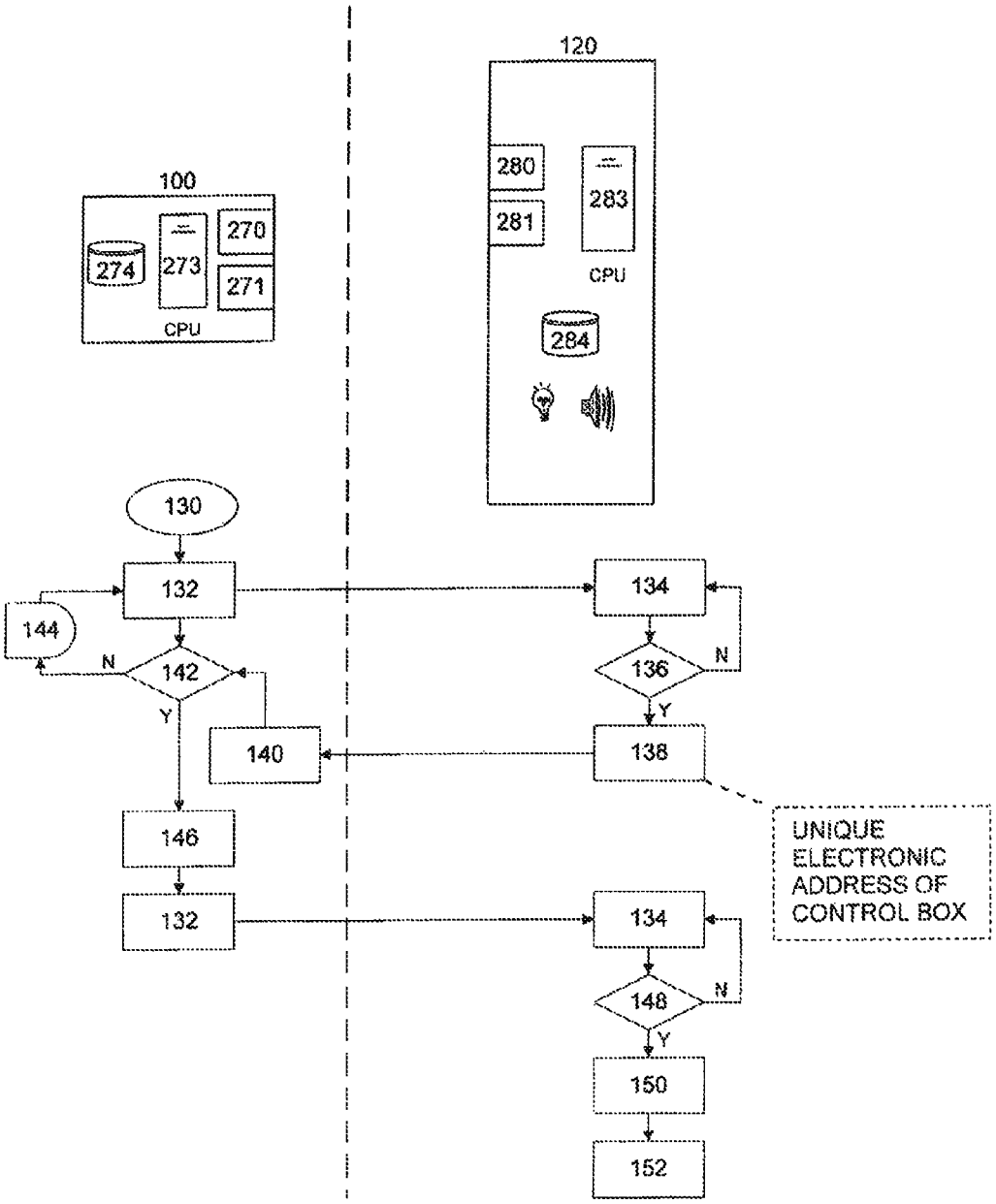
FIG. 3 shows a flow chart for pairing a patient lift with a remote control.

FIG. 3 shows a flow chart for pairing a patient lifter with a remote control unit. The pairing between the remote control unit 100 and the control box 120 of the patient lift 102 is initialized 130 in that an initialization key on the remote control unit 100 is activated. Hereby, two successive initialization request and the last registered address are transmitted 132 via transmitter 271 to the control box 120. Until then, the control box concerned has been in standby mode. The control box 120 receives 134 the initialization request via receiver 280. If two corresponding initialization requests are registered 136 by the CPU 283 of the control box, an initialization response containing the address of the control box 120 is transmitted 138 via transmitter 281 to the remote control 100. If the two initialization requests do not correspond, these are not registered by the CPU 283 of the control box and the control box 120 is prepared for receiving 134. The remote control 100 receives 140 via receiver 270 the initialization response from the control box 120. If the initialization response is correct 142, the sent address is saved 146 in the memory 274 of the remote control 100. If the initialization response is not correct, the remote control 100 waits before it resends 132 an initialization request via transmitter 271. The remote control 100 subsequently sends 132 two successive initialization requests and the last registered address to the control box 120. This time the address being sent is the address of the control box. The control box 120 receives 134 the initialization request via receiver 280. If two corresponding initialization requests with the address of the control box are sent, this is registered 150 via the CPU 284 of the control box and the control box 102 sends out a signal for instance acoustic, visual, or tactile. If two corresponding initialization requests with the address of the control box are not received, these are not registered 148 and the control box 120 is prepared for receiving 134 new ones.

The communication between remote control and control box respectively is in an embodiment infra-red and in the following, the specifications are described in relation to an embodiment of an IR-protocol, where this is illustrated in the FIGS. 4*a*-4*c*.

Figure 4A:
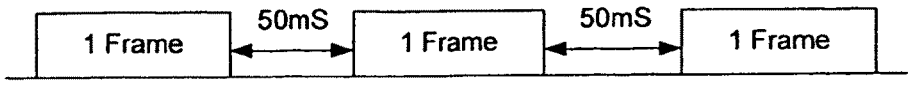
FIG. 4*a* shows the general timing between the individual frames.

The communication is frame based and FIG. 4*a* shows the general timing between the individual frames. A frame comprises a number of bits where one (1) bit has duration of one (1) millisecond (mS). Between each two frames there is "idle" of 5 bytes corresponding to a duration of 50 mS. The idle time between two bytes in a frame must be. less than one byte in time, otherwise the system switches to "idle" and the preceding bytes in a frame will be discarded.

Figure 4B:
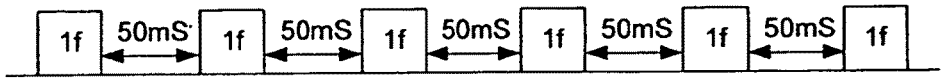
FIG. 4*b* shows the data flow in the normal one-way communication between the remote control and the control box.

FIG. 4*b* shows the data flow in the normal one-way communication between the remote control unit 100 and the control box 120 in FIG. 1. The individual bytes in a frame indicate which key on the remote control unit 100 has been activated. The remote control can for instance transmit up to 150 mS after the activation of the key has been released.

Figure 4C:
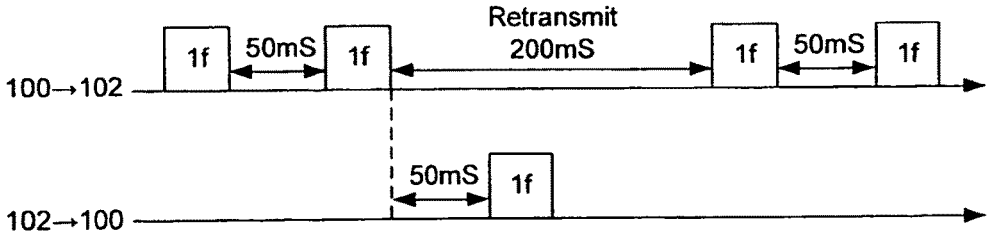
FIG. 4*c* shows the data flow in the two-way communication between the remote control and the control box during pairing.

FIG. 4*c* shows the data flow in the two-way communication between the remote control unit 100 and the control box 120 during pairing of these. An example of pairing between these two is described in FIG. 3. These two frames are received and registered by the control box 120, after which the control box 120 sends a response, a frame, to the remote control 100 within a space of time of 50 mS. If the remote control 100 does not send this response, the control box 120 will resend two frames within 200 mS after the last transmitted frame.

DRAWING NUMERALS

100 remote control unit
102 patient lifter
104 drive wheels
106 chassis
108 arm
110 carrying strap
112 linear actuator
114 rear mounting
116 actuating rod
118 front mounting
120 control box
122 hand control
124 'keys'
130 starting of the initialization

132 sending initialization request
134 receiving initialization request
136 controlling initialization request
138 sending initialization response
140 receiving initialization response
142 controlling initialization response
144 stand-by function
146 saving initialization response
148 controlling initialization request
150 registering initialization request
152 signal: acoustic, visual, tactile
260 service remote control unit
262 module for extended service
264 IR/USB module
266 computer
270 receiver of the remote control unit
271 transmitter of the remote control unit
273 CPU of the remote control unit
274 memory of the remote control unit
280 receiver of the control box
281 transmitter of the control box
283 memory of the control box
284 CPU of the control box

The invention claimed is:

1. A combination of an articulated apparatus and a remote controller for controlling the articulated apparatus, comprising:

said articulated apparatus comprising an actuator system which includes a linear electromechanical actuator, a power supply, and a control box with a computer, a memory, a receiver and a transmitter, said control box having a unique electronic address to uniquely identify said control box from other control boxes, and said remote controller comprising a computer, a memory, a transmitter and a receiver, said memory of said remote controller containing a previously registered electronic address, wherein said remote controller is configured, when activated by a user, to initiate an electronic pairing of said remote controller and said control box by transmitting multiple initialization requests from said remote controller to said control box wherein said initialization requests include said previously registered electronic address, said initialization requests initiating said electronic pairing of said remote controller and said control box;

wherein said control box is configured, in response to said initialization request, to transmit an initialization response from said control box to said remote controller wherein said initialization response includes said unique electronic address of said control box, said electronic pairing further comprising said initialization response;

wherein said remote controller is further configured, in response to said initialization response, to save said unique electronic address in said memory of said remote controller and to repeat transmission of multiple initialization requests to said control box wherein said repeated initialization requests comprise said unique electronic address, said electronic pairing further comprising said saving of said unique electronic address and said repeated initialization requests comprising said unique electronic address, and wherein said control box is further configured to determine when said unique electronic address included with said repeated initialization requests correspond to said unique electronic address of said control box and output a user-perceptible signal indicating that said remote controller and said control box have been electronically paired, and wherein as a result of said electronic pairing, said remote controller is configured to generate commands for controlling said articulated apparatus that include said unique electronic address of said control box, wherein said output signal is independent of any movements of the articulated apparatus due to commands issued by said user to operate the articulated apparatus and wherein after said activation by said user to initiate said electronic pairing, said electronic pairing proceeds without user input or intervention.

2. The combination of claim 1, wherein said articulated apparatus includes a light indicator which illuminates as said outputted signal indicating that said remote controller and said control box have been paired.

3. The combination of claim 1, wherein said articulated apparatus includes a buzzer which buzzes as said outputted signal indicating that said remote controller and said control box have been paired.

4. The combination of claim 1, wherein said articulated apparatus is a patient lifter.

5. The combination of claim 1, wherein said outputted signal comprises at least one of an acoustic, visual, and tactile signal.

6. The combination of claim 1 wherein said control box is further configured to register said initialization request for electronic pairing when at least two initialization requests correspond.

7. The combination of claim 1 wherein at least one of said control box and said remote control is configured to transmit with IR-power.

8. A method of controlling an articulated apparatus with a remote controller where the articulated apparatus includes an actuator system with a linear electromechanical actuator, a power supply, and a control box with a computer, a memory, a receiver and a transmitter wherein said control box has a unique electronic address to uniquely identify said control box from other control boxes, and said remote controller includes a computer, a memory, a transmitter and a receiver, and wherein said memory of said remote controller contains a previously registered electronic address, said method comprising:

transmitting, from said remote controller when activated by a user, a first plurality of initialization requests to said control box to initiate an electronic pairing of said remote controller and said control box wherein said initialization requests include said previously registered electronic address, said initialization requests initiating said electronic pairing of said remote controller and said control box;

transmitting, from said control box in response to said initialization request, an initialization response to said remote controller wherein said initialization response includes said unique electronic address of said control box, said electronic pairing further comprising said initialization response;

receiving, at said remote controller, said initialization response and saving said unique electronic address in said memory of said remote controller;

transmitting, from said remote controller to said control box, a second plurality of initialization requests comprising said unique electronic address from said remote controller memory, said electronic pairing further comprising said saving of said unique electronic address and said repeated initialization requests comprising said unique electronic address; and outputting, at said control box, a user-perceptible signal indicating that said remote controller and said control box have been electronically paired, when said unique electronic address included with said second plurality of initialization requests correspond to said unique electronic address of said control box, and wherein as a result of said electronic pairing, said remote controller is configured to generate commands for controlling said articulated apparatus that include said unique electronic address of said control box, and wherein said output signal is independent of any movements of the articulated apparatus due to commands issued by said user to operate the articulated apparatus and wherein after said activation by said user to initiate said electronic pairing, said electronic pairing proceeds without user input or intervention.

9. The method of claim 8 further comprising:

registering, at said control box, said initialization request for electronic pairing when at least two initialization requests correspond.

* * * * *